US012648646B2

(12) United States Patent
Siao

(10) Patent No.: US 12,648,646 B2
(45) Date of Patent: Jun. 9, 2026

(54) FOLDABLE CHAIR

(71) Applicant: JING SI PURELAND CO., LTD., Taipei (TW)

(72) Inventor: Marshall Q. Siao, Xincheng Township, Hualien County (TW)

(73) Assignee: JING SI PURELAND CO., LTD., Taipei (TW)

( * ) Notice: Subject to any disclaimer, the term of this patent is extended or adjusted under 35 U.S.C. 154(b) by 250 days.

(21) Appl. No.: 18/501,773

(22) Filed: Nov. 3, 2023

(65) Prior Publication Data

US 2024/0148147 A1 May 9, 2024

(30) Foreign Application Priority Data

Nov. 4, 2022 (TW) ..... 111142292

(51) Int. Cl.
*A47C 4/02* (2006.01)
*A47C 4/04* (2006.01)
*A47C 4/28* (2006.01)

(52) U.S. Cl.
CPC ..... *A47C 4/283* (2013.01); *A47C 4/02* (2013.01); *A47C 4/045* (2013.01)

(58) Field of Classification Search
CPC ..... A47C 4/02; A47C 4/045
See application file for complete search history.

(56) References Cited

U.S. PATENT DOCUMENTS 4,630,861 A * 12/1986 Henschel ..... A47C 4/08 297/44
7,905,184 B2 * 3/2011 Eveleth ..... A47C 4/045 297/44 X
8,146,518 B2 * 4/2012 Eveleth ..... A47C 4/045 297/44 X
8,661,991 B2 * 3/2014 Eveleth ..... A47B 3/08 297/44 X
8,696,052 B2 4/2014 Zhu
D777,464 S 1/2017 Siao
10,694,859 B1 * 6/2020 Wickland ..... A47C 4/045
11,903,486 B2 * 2/2024 Dokhanian ..... A47C 4/045
12,127,684 B2 * 10/2024 Kastelic ..... A47C 4/045
(Continued)

FOREIGN PATENT DOCUMENTS

BR 8800120 U2 * 10/2009 ..... A47C 4/045
CN 201422631 Y * 3/2010 ..... A47C 4/045
(Continued)

*Primary Examiner* — Rodney B White
(74) *Attorney, Agent, or Firm* — ScienBiziP, P.C.

(57) ABSTRACT

A foldable chair is provided. The foldable chair includes two supporting side frames, two connecting plates, a seat plate and a back plate. The two supporting side frames are each formed with a first supporting part and a second supporting part. The two connecting plates are arranged between the two supporting side frames and are pivotally connected to the two supporting side frames. The seat plate is arranged between the first supporting parts of the two supporting side frames, and both sides of the seat plate are pivotally connected to the first supporting parts of the two supporting side frames. An inner side of at least one of the two supporting side frames, the two connecting plates, the seat plate, or the back plate is formed with a reinforcement structure.

9 Claims, 10 Drawing Sheets

(56) References Cited

U.S. PATENT DOCUMENTS

| | | | | |
|---|---|---|---|---|
| 2009/0261643 | A1 | 10/2009 | Kay | |
| 2013/0048428 | A1 | 2/2013 | Chancler | |
| 2013/0228103 | A1* | 9/2013 | Eveleth | A47C 4/20 108/115 |
| 2016/0220026 | A1 | 8/2016 | Siao | |
| 2022/0338635 | A1* | 10/2022 | Jha | A47C 4/02 |
| 2024/0108144 | A1* | 4/2024 | Merey | A47C 12/00 |
| 2024/0148150 | A1* | 5/2024 | Siao | A47C 4/08 |
| 2024/0172875 | A1* | 5/2024 | Dokhanian | A47C 4/045 |

FOREIGN PATENT DOCUMENTS

| | | | | | |
|---|---|---|---|---|---|
| CN | 110623455 | A | * | 12/2019 | A47C 7/42 |
| CN | 212382368 | U | | 1/2021 | |
| JP | H07061352 | A | | 3/1995 | |
| JP | H11123778 | A | | 5/1999 | |
| JP | 2008259668 | A | | 10/2008 | |
| JP | 3159702 | U | | 6/2010 | |
| JP | 2020534107 | A | | 11/2020 | |
| JP | 2022051603 | A | | 4/2022 | |
| KR | 972608 | B1 | * | 7/2010 | A47C 4/045 |
| KR | 10-2020-0057733 | A | | 5/2020 | |
| KR | 10-2223615 | B1 | | 3/2021 | |
| TW | M492107 | U | | 12/2014 | |
| TW | M516904 | U | | 2/2016 | |
| TW | M537847 | U | | 3/2017 | |
| WO | 2022188939 | A1 | | 9/2022 | |

* cited by examiner

10

300

200

500

400

FOLDABLE CHAIR

CROSS-REFERENCE TO RELATED APPLICATION(S)

The present application claims the benefit of and priority to Taiwan Patent Application Serial No. 111142292, filed on Nov. 4, 2022, entitled "FOLDING CHAIRS", the contents of which are hereby incorporated herein fully by reference into the present application for all purposes.

FIELD

The present disclosure generally relates to a foldable chair and, more particularly, a foldable chair with an improved load-carrying capacity, which may be folded to reduce volume and facilitate storage.

BACKGROUND

Chairs are highly practical and widely used in various occasions in daily life. On the other hand, in order to improve mobility in temporary locations, smaller and lighter chairs are developed to facilitate transport. However, the above-mentioned chairs are all fixed structures, occupying a fixed volume, and may only be stored in a stacked manner. Furthermore, the volume that is reduced during storage is still not very significant, and it is impossible to store more chairs in a limited space, thus causing inconvenience. Compared with the chair made by the one-piece molding method, many types of foldable chairs on the market have the convenience of carrying or transporting, being able to reduce the occupied space under storage or storage, and improve the flexibility of use requirements. However, the most common foldable chair is simply composed of several plates in a combined or pivoted manner, and its overall strength has not been designed and strengthened. Therefore, the chair may not provide stable support under normal conditions for the user to sit on.

SUMMARY

In view of the above, it is necessary to provide a foldable chair that has better overall load capacity and may be easily stored when not in use.

In a first aspect of the present disclosure, a foldable chair is provided. The foldable chair includes two supporting side frames each formed with a first supporting part and a second supporting part; two connecting plates each formed with a first folding line, the two connecting plates arranged between the two supporting side frames and pivotally connected to each of the two supporting side frames, the two connecting plates are foldable in a flat manner through the first folding line; a seat plate formed with a second folding line, the seat plate is arranged between two first supporting parts of the two supporting side frames, two sides of the seat plate are respectively and pivotally connected to the two first supporting parts of the two supporting side frames, such that the seat plate is foldable in a flat manner through the second folding line; and a back plate formed with a third folding line, the back plate arranged between two second supporting parts of the two supporting side frames, two sides of the back plate are respectively and pivotally connected to the two second supporting parts of the two supporting side frames, such that the back plate is foldable in a flat manner through the third folding line, where an inner side of at least one of the two supporting side frames, the two connecting plates, the seat plate, or the back plate is formed with a reinforcement structure; and each of the two connecting plates is foldable in a flat manner along the first folding line, the seat plate is foldable in a flat manner along the second folding line, and the back plate is f foldable in a flat manner along the third folding line, such that a distance between the two supporting side frames is reduced.

In an implementation of the first aspect of the present disclosure, a top portion of one of the two connecting plates is formed with a limiting column, and the seat plate comprises a limiting hole corresponding to the limiting column, when the seat plate and the two connecting plates are unfolded, the limiting column is inserted into the limiting hole.

In an implementation of the first aspect of the present disclosure, each of the two connecting plates comprises a first plate and a second plate, and the reinforcement structure is formed on an inner side of each of the first plate and the second plate.

In an implementation of the first aspect of the present disclosure, the seat plate comprises a first bearing plate and a second bearing plate, and the reinforcement structure is formed on an inner side of each of the first bearing plate and the second bearing plate.

In an implementation of the first aspect of the present disclosure, the back plate comprises a first supporting plate and a second supporting plate, and the reinforcement structure is formed on an inner side of each of the first supporting plate and the second supporting plate.

In an implementation of the first aspect of the present disclosure, the two second supporting parts of the two supporting side frames are each formed with at least one top supporting part extending from a back plate relative pivot part, when two sides of the back plate are respectively and pivotally connected to the two second supporting parts of the two supporting side frames, the at least one top supporting part is configured to provide support to the back plate to pivotally connect to one side of one of the second supporting parts.

In an implementation of the first aspect of the present disclosure, the reinforcement structure further including a plurality of reinforcing lattices arranged in a honeycomb shape; a plurality of reinforcing rings, each of the plurality of reinforcing rings formed in each of the plurality of reinforcing lattices; a plurality of reinforcing ribs, each of the plurality of reinforcing ribs connected between an inner wall of one of the plurality of reinforcing lattices and an outer wall of one of the plurality of reinforcing ring.

In an implementation of the first aspect of the present disclosure, the plurality of reinforcing rings is formed with a through hole.

In an implementation of the first aspect of the present disclosure, each of the plurality of reinforcing lattices comprises six lattice ribs and is arranged in the honeycomb shape in a hexagonal pattern, each of the lattice ribs simultaneously serves as a common lattice rib for two of the plurality of reinforcing lattices; the plurality of reinforcing rings are all arranged in the plurality of reinforcing lattices in a circular shape; three adjacent reinforcing lattices in the plurality of reinforcing lattices comprise a common intersection point, and the common intersection point is formed by three intersecting lattice ribs in the plurality of lattice ribs; and one of the plurality of reinforcing ribs extends along a direction of one of the three intersecting lattice ribs, such that the common intersection point and one of the plurality of reinforcing rings are connected.

In an implementation of the first aspect of the present disclosure, at a bottom portion of each of the two supporting side frames and at a bottom portion of each of the two connecting plates comprise at least one anti-slip pad.

BRIEF DESCRIPTION OF THE DRAWINGS

The present disclosure will be better understood from the following detailed description read in light of the accompanying drawings, where.

DETAILED DESCRIPTION

Figure 1:
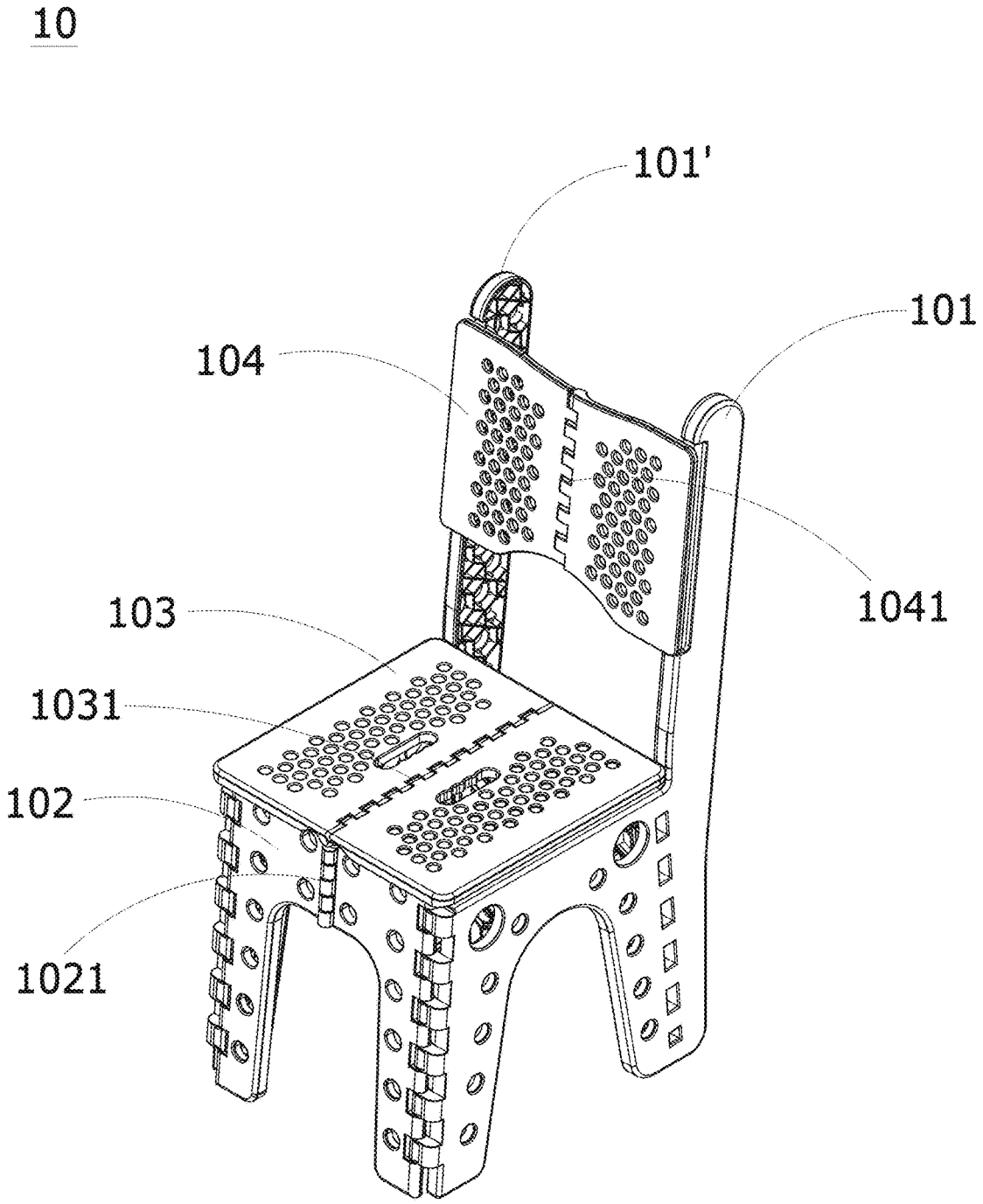
FIG. 1 is a perspective view illustrating a foldable chair according to an example implementation of the present disclosure.

The following disclosure contains specific information pertaining to exemplary implementations in the present disclosure. The drawings in the present disclosure and their accompanying detailed disclosure are directed to merely exemplary implementations. However, the present disclosure is not limited to merely these exemplary implementations. Other variations and implementations of the present disclosure will occur to those skilled in the art. Unless noted otherwise, like or corresponding elements among the figures may be indicated by like or corresponding reference numerals. Moreover, the drawings and illustrations in the present disclosure are generally not to scale and are not intended to correspond to actual relative dimensions.

For the purposes of consistency and ease of understanding, like features are identified (although, in some examples, not shown) by numerals in the exemplary figures. However, the features in different implementations may be different in other respects, and thus shall not be narrowly confined to what is shown in the figures.

The disclosure uses the phrases "in one implementation," "in some implementations," and so on, which may each refer to one or more of the same or different implementations. The term "coupled" is defined as connected, directly or indirectly through intervening components and is not necessarily limited to physical connections. The term "comprising" means "including, but not necessarily limited to;" it specifically indicates open-ended inclusion or membership in the so-described combination, group, series and the equivalent.

Additionally, for the purposes of explanation and non-limitation, specific details, such as functional entities, techniques, protocols, standard, and the like, are set forth for providing an understanding of the described technology. In other examples, detailed disclosure of well-known methods, technologies, systems, architectures, and the like are omitted so as not to obscure the disclosure with unnecessary details.

The terms "first," "second," "third," and the like in the specification and the above-mentioned drawings of the present disclosure are used to distinguish between different objects rather than to describe a specific order. Additionally, the term "comprising" and its variations are intended to encompass non-exclusive inclusion. For example, processes, methods, systems, products, or devices that encompass a series of steps or modules are not limited to the steps or modules listed, but may optionally include steps or modules not listed, or optionally include other inherent steps or modules for those processes, methods, products, or devices.

The present disclosure will be described in further detail with reference to the attached drawings.

Referring to FIG. 1, a foldable chair 10 is shown. The foldable chair 10 includes two supporting side frames (101, 101'), two connecting plates (102, 102'), a seat plate 103, and a back plate 104. The two supporting side frames (101, 101') are arranged correspond to each other, and each of the two connecting plates (102, 102') forms a first folding line 1021, where the connecting plates 102' is not shown in FIG. 1, please refer to FIG. 3. The two connecting plates (102, 102') are respectively arranged between the two supporting side frames (101, 101') and pivotally connected to the two supporting side frames (101, 101'). The two connecting plates (102, 102') may be folded flat through the first folding line 1021. The seat plate 103 has a second folding line 1031 and is located between the two supporting side frames (101, 101'). The two sides of the seat plate 103 are pivotally connected to the two supporting side frames (101, 101'). The seat plate 103 may be folded flat through the respective second folding line 1031. The back plate 104 has a third folding line 1041 and the back plate 104 is arranged between the two supporting side frames (101, 101'). The two sides of the back plate 104 are pivotally connected to the two supporting side frames (101, 101'). The back plate 104 may be folded flat through the third folding line 1041.

Figure 2:
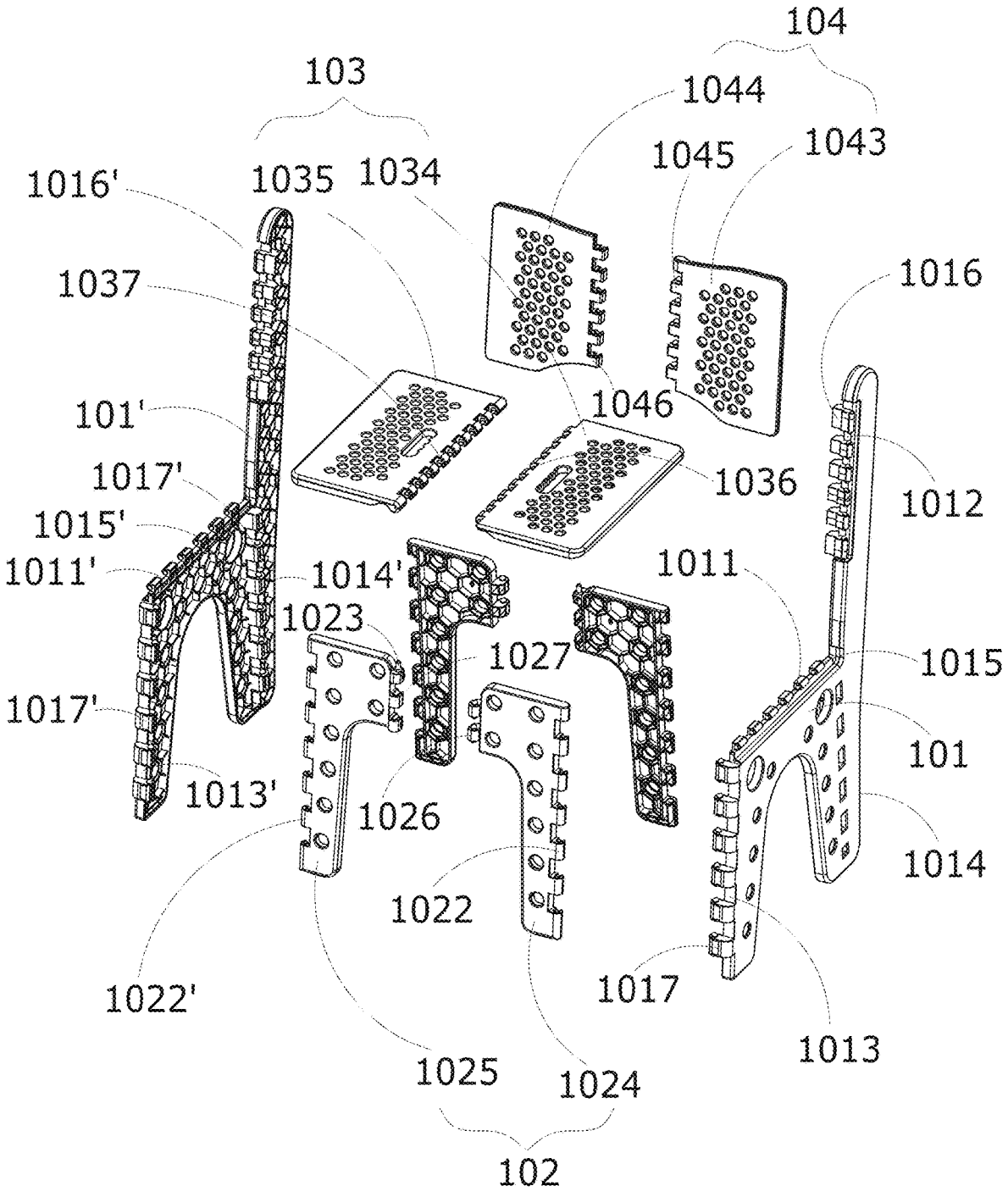
FIG. 2 is an exploded view illustrating a foldable chair according to an example implementation of the present disclosure.
Figure 3:
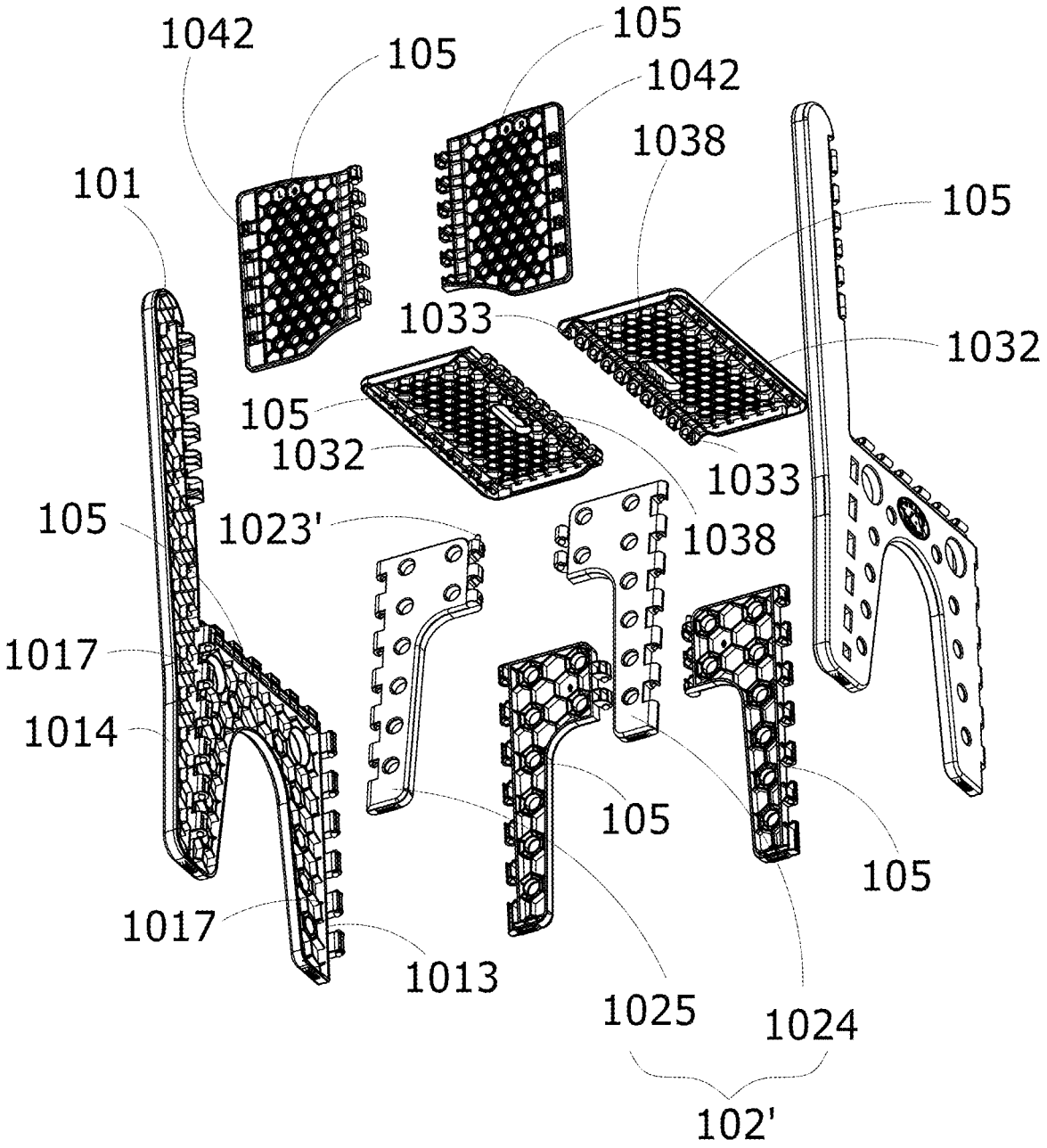
FIG. 3 is an exploded view illustrating a foldable chair according to another example implementation of the present disclosure.

Please refer to FIG. 2 and FIG. 3. The foldable chair 10 includes two supporting side frames (101, 101'), two connecting plates (102, 102'), a seat plate 103, and a back plate 104. Each supporting side frame 101 is formed with a first supporting part 1011, a second supporting part 1012, a third supporting part 1013, and a fourth supporting part 1014. The first supporting part 1011 is formed with at least one seat plate relative pivot part 1015, and the second supporting part 1012 is formed with at least one back plate relative pivot part 1016. The third supporting part 1013 and the fourth supporting part 1014 are each formed with at least one connecting plate relative pivot part 1017. The supporting side frame 101 has a reinforcement structure 105 in an inner portion thereof, and the structure of the supporting side frame 101' is the same as the supporting side frame 101, which is not described in detail here. The two connecting plates (102, 102') are each formed with at least one connecting plate pivot connector (1022, 1022') on both sides. The two connecting plates (102, 102') are pivoted to the connecting plate relative pivot part (1017, 1017') of the third supporting parts (1013, 1013') and the fourth supporting parts (1014, 1014') by the connecting plate pivot connectors (1022, 1022') on both sides, so that the two connecting plates (102, 102') are arranged between the third supporting parts (1013, 1013') and the fourth supporting parts (1014, 1014') of the two supporting side frames (101, 101'). In one implementation, each of the connecting plates (102, 102') includes a first plate 1024 and a second plate 1025. The reinforcement structure 105 is formed on inner sides of the first plate 1024 and the second plate 1025. One side of the first plate 1024 is formed with at least one plate pivot connector 1026, while one side of the second plate 1025, corresponding to the plate pivot connector 1026, is formed with a plate relative pivot connector 1027. The first plate 1024 is pivotally connected to the plate relative pivot connector 1027 of the second plate 1025 through the plate pivot connector 1026, thus allowing the first plate 1024 to fold flat relative to the second plate 1025. Each of the first plates 1024 and the second plates 1025 is formed with the connecting plate pivot connectors (1022, 1022') on a side correspond to the third supporting part 1013 or the fourth supporting part 1014. The first plate 1024 and the second plate 1025 may pivotally connect to the connecting plate relative pivot parts (1017, 1017') of the third supporting part 1013 and the fourth supporting part 1014 through the connecting plate pivot connectors (1022, 1022'). The reinforcement structure 105 is formed on inner sides of the first plate 1024 and the second plate 1025. The reinforcement structure 105 is formed on an inner side of the seat plate 103. Both sides of the seat plate 103 is formed with at least one seat plate pivot connector 1032 corresponding to the two first supporting parts (1011, 1011'). The seat plate 103 is pivotally connected to the seat plate relative pivot parts (1015, 1015') of the two first supporting parts (1011, 1011') through the seat plate pivot connectors 1032 on both sides, thus allowing the seat plate 103 to be arranged between the two first supporting parts (1011, 1011'). In one implementation, the seat plate 103 includes a first bearing plate 1034 and a second bearing plate 1035. The reinforcement structure 105 is formed on inner sides of the first bearing plate 1034 and the second bearing plate 1035. One side of the first bearing plate 1034 is formed with at least one bearing plate pivot connector 1036, while one side of the second bearing plate 1035 that faces the bearing plate pivot connector 1036 is formed with at least one bearing plate relative pivot connector 1037. The first bearing plate 1034 may pivotally connect to the bearing plate relative pivot connector 1037 through the bearing plate pivot connector 1036, thus allowing the first bearing plate 1034 to fold flat corresponding to the second bearing plate 1035. The seat plate pivot connectors 1032 are formed on sides of the first bearing plate 1034 and the second bearing plate 1035 facing the two first supporting parts (1011, 1011'). The first bearing plate 1034 and the second bearing plate 1035 may pivotally connect to the seat plate relative pivot part 1015 of the two first supporting parts (1011, 1011') through the seat plate pivot connectors 1032. Additionally, each of the first bearing plate 1034 and the second bearing plate 1035 are formed with a handle hole 1038. In one implementation, the top portions of the two connecting plates (102, 102') are formed with limiting columns (1023, 1023'). The seat plate 103 is formed with a limiting hole 1033 correspond to the limiting columns (1023, 1023'). When the seat plate 103 and the two connecting plates (102, 102') are unfolded, the limiting columns (1023, 1023') may be inserted into the limiting hole 1033, which then securely limits the seat plate 103 onto the two connecting plates (102, 102'). The reinforcement structure 105 is formed on an inner side of the back plate 104. The back plate 104 is formed with at least one back plate pivot connector 1042 on both sides of the back plate 104 corresponding to the two second supporting parts (1012, 1012'). The two sides of the back plate 104 are pivotally connected to the back plate relative pivot parts (1016, 1016') of the two second supporting parts (1012, 1012') through the back plate pivot connectors 1042, thus allowing the back plate 104 to be arranged between the two second supporting parts (1012, 1012'). In one implementation, the back plate 104 includes a first supporting plate 1043 and a second supporting plate 1044. The reinforcement structure 105 is formed on inner sides of the first supporting plate 1043 and the second supporting plate 1044. One side of the first supporting plate 1043 is formed with at least one supporting plate pivot connector 1045, while one side of the second supporting plate 1044 that faces the supporting plate pivot connector 1045 is formed with at least one supporting plate relative pivot connector 1046. The first supporting plate 1043 may pivotally connect to the supporting plate relative pivot connector 1046 through the supporting plate pivot connector 1045, thus allowing the first supporting plate 1043 to fold in a flat manner corresponding to the second supporting plate 1044. The back plate pivot connectors 1042 are respectively formed on the sides of the first supporting plate 1043 and the second supporting plate 1044 that face the two second supporting parts (1012, 1012'). The first supporting plate 1043 and the second supporting plate 1044 may pivotally connect to the back plate relative pivot parts 1016 of the two second supporting parts (1012, 1012') through the back plate pivot connectors 1042, thus allowing the other sides of the first supporting plate 1043 and the second supporting plate 1044 to pivotally connect to the two second supporting parts (1012, 1012'). In one implementation, the above components are combined as shown in FIG. 1.

Figure 4:
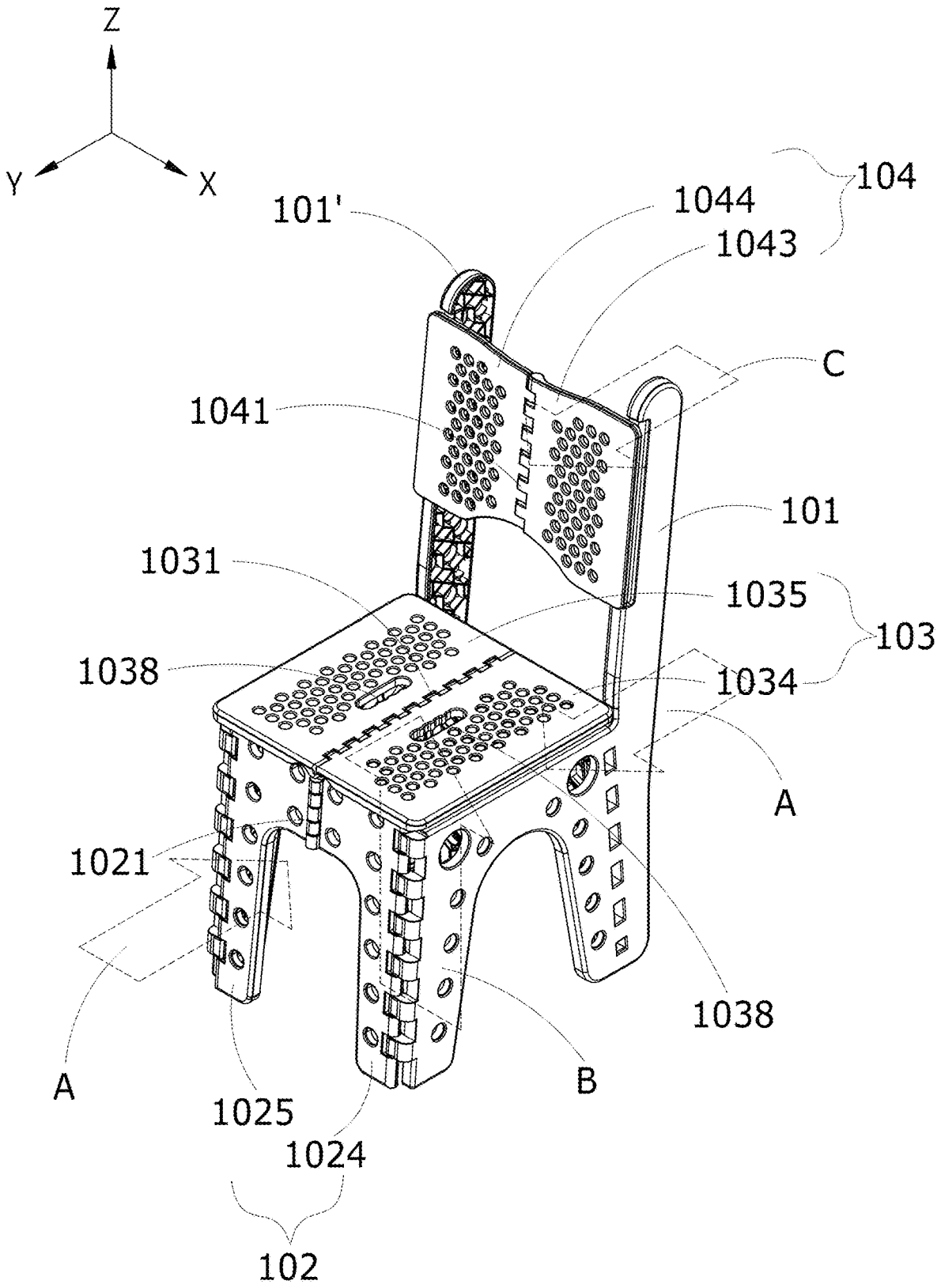
FIG. 4 is a perspective view illustrating a foldable chair according to an example implementation of the present disclosure.

Please refer to FIG. 4 and FIG. 3. First, define a coordinate system with a three-dimensional orientation for illustration. The three directions are referred to as the X direction, Y direction, and Z direction. These three directions are mutually perpendicular, and the X direction and Y direction represent the longitudinal and transverse directions on the same horizontal plane, while the Z direction represents the vertical direction. As shown in FIG. 4, the two supporting side frames (101, 101') are spaced apart and arranged relative to each other in the X direction. The pivot part of the first plate 1024 and the second plate 1025 of the two connecting plates (102, 102') is further defined as the first folding line 1021, which extends approximately in the Z direction. Therefore, the first plate 1024 and the second plate 1025 may pivot relatively through the first folding line 1021, allowing the first plate 1024 and the second plate 1025 to fold flat, transforming the connecting plates (102, 102') from a planar shape to a folded shape. The seat plate 103 includes the first bearing plate 1034 and the second bearing plate 1035, which are pivotally connected, and the pivot part between the first bearing plate 1034 and the second bearing plate 1035 is defined by the second folding line 1031 extending approximately in the Y direction. Therefore, the first bearing plate 1034 and the second bearing plate 1035 may pivot relatively through the second folding line 1031, thus allowing the seat plate 103 to fold flat, and transforming the seat plate 103 from a planar shape to a folded shape. Similarly, the back plate 104 includes the first supporting plate 1043 and the second supporting plate 1044, which are pivotally connected, and the pivot point between the first supporting plate 1043 and the second supporting plate 1044 is defined by the third folding line 1041 that extends approximately in the Z direction. Therefore, the first supporting plate 1043 and the second supporting plate 1044 may pivot relatively through the third folding line 1041, thus allowing the back plate 104 to fold flat, and transforming the back plate 104 from a planar shape to a folded shape.

Figure 5:
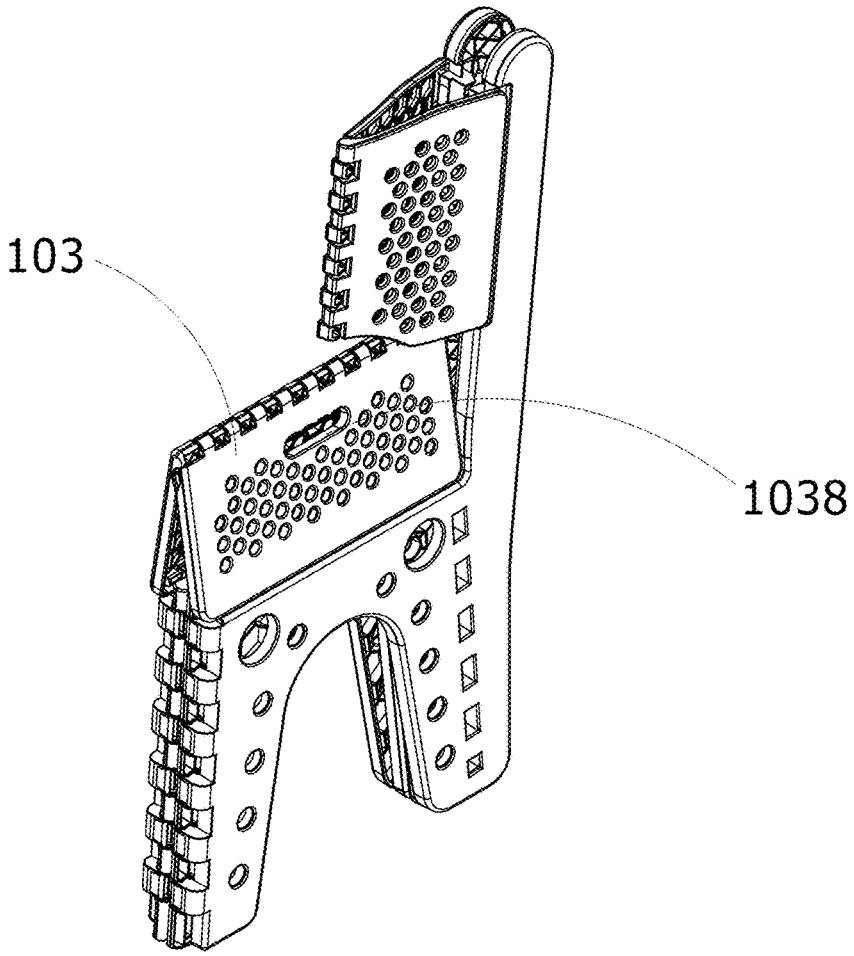
FIG. 5 is another perspective view illustrating the foldable chair according to another example implementation of the present disclosure.

Furthermore, the first folding line 1021 of the two connecting plates (102, 102'), the second folding line 1031 of the seat plate 103, and the third folding line 1041 of the back plate 104 are located on the same plane (the Y-Z plane), and the distance between the plane and the two supporting side frames (101, 101') is equal. In other words, the positions of the two supporting side frames (101, 101') are symmetric with respect to the plane formed by the folding lines (1021, 1031, 1041). In summary, when folding the foldable chair 10 of the present disclosure, a slight force is applied to bend the components. The folding process is as follows: the two connecting plates (102, 102') are folded along the first folding line 1021 (as indicated by arrow A in FIG. 4) to fold the first plate 1024 and the second plate 1025. The seat plate 103 is folded along the second folding line 1031 (as indicated by arrow B in the FIG. 4) to fold the first bearing plate 1034 and the second bearing plate 1035. The back plate 104 is folded along the third folding line 1041 (as indicated by arrow C in the FIG. 4) to fold the first supporting plate 1043 and the second supporting plate 1044, thus causing the two supporting side frames (101, 101') to move closer to each other in the X direction and reducing the distance between the two supporting side frames (101, 101') as shown in FIG. 5. In one implementation, the foldable chair of the present disclosure transforms from the chair form to the folded form as shown in FIG. 5, thus significantly reducing its occupied volume, so that more foldable chairs of the present disclosure may be accommodated in a limited accommodation space. The aforementioned force is primarily applied to the pivot parts of each component or the folding lines (1021, 1031, 1041) to facilitate folding flat of the components. Furthermore, as shown in FIG. 5, since the first bearing plate 1034 and the second bearing plate 1035 of the seat plate 103 are formed with handle holes 1038, when the first bearing plate 1034 and the second bearing plate 1035 of the seat plate 103 are folded, the handle holes 1038 come close to each other. Therefore, users may hold and carry the folded foldable chair 10 conveniently.

Figure 6:
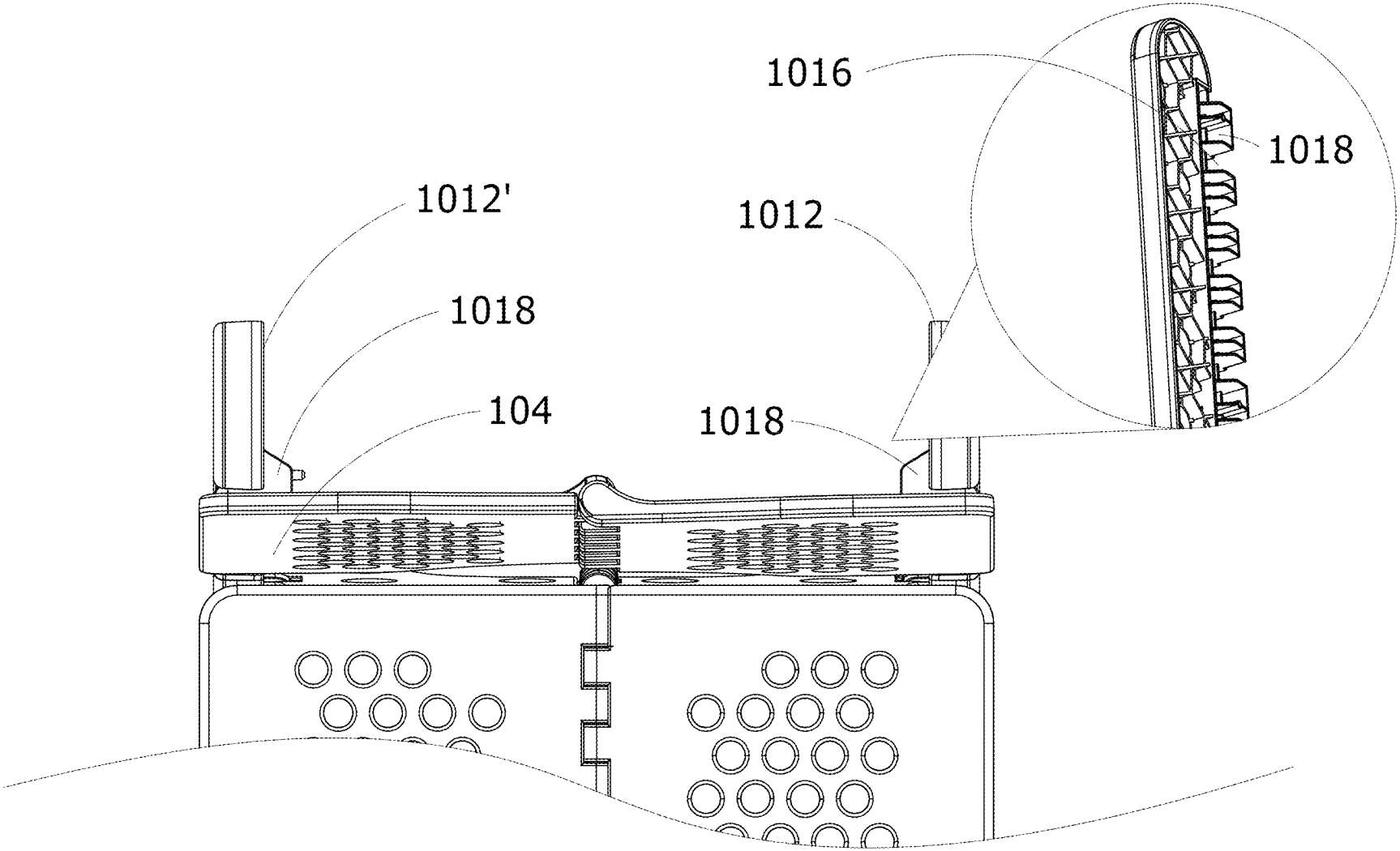
FIG. 6 is a schematic diagram illustrating a foldable chair according to an example implementation of the present disclosure.

Please refer to FIG. 6. In one implementation, the second supporting parts (1012, 1012') of the two supporting side frames (101, 101') are each formed with at least one top supporting part 1018 that extends from the back plate relative pivot part 1016. When the two sides of the back plate 104 are pivotally connected to the two second supporting parts (1012, 1012'), the top supporting part 1018 may provide additional support to the back plate 104 by pivotally connects to one side of the second supporting parts (1012, 1012'), which enhances the overall support and stability of the back plate 104.

Figure 7:
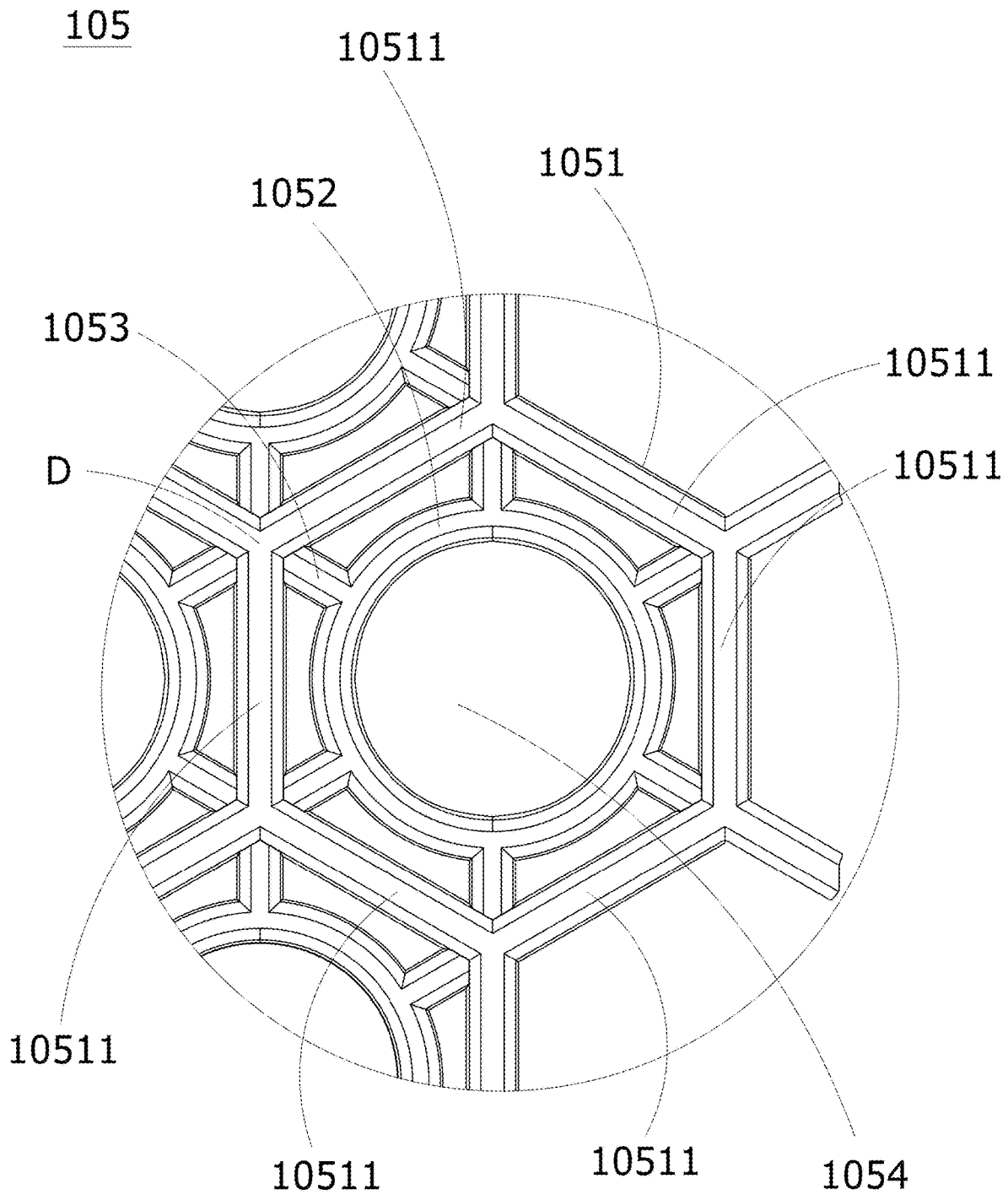
FIG. 7 is a schematic diagram illustrating a foldable chair according to an example implementation of the present disclosure.

Please refer to FIG. 7. The reinforcement structure further includes a plurality of reinforcing lattices 1051, which is arranged in a honeycomb pattern. A plurality of reinforcing rings 1052 is formed in each of the reinforcing lattices 1051. A plurality of the reinforcing ribs 1053, where each of the reinforcing ribs 1053 is connected between the inner wall of one of the reinforcing lattices 1051 and the outer wall of one of the plurality of reinforcing rings 1052. The reinforcing rings 1052 and the reinforcing ribs 1053 strengthen the overall strength of the reinforcement structure 105. Additionally, the reinforcing rings 1052 may have through hole 1054 to further enhance the strength of the reinforcement structure 105. In one implementation, each reinforcing lattices 1051 has six lattice ribs 10511, and each of the reinforcing lattices 1051 is arranged in the honeycomb shape in a hexagonal pattern, and each of the lattice ribs 10511 serves as a common lattice rib for two of the plurality of reinforcing lattices 1051. The reinforcing rings 1052 are circular and arranged in the reinforcing lattices 1051. Three adjacent reinforcing lattices 1051 in the reinforcing structure 105 have a common intersection point D formed by three intersecting lattice ribs 10511. One of the plurality of the reinforcing ribs 1053 extends along a direction of one of the three intersecting lattice ribs 10511, such that the common intersection point D and a specific one of the plurality of reinforcing rings 1052 are connected. In one implementation, the specific one of the three intersecting lattice ribs 10511 is not arranged corresponding to the specific one of the reinforcing rings 1052, but the specific one of the three intersecting lattice ribs 10511 and the specific one of the reinforcing rings 1052 are coupled to the common intersection point D through reinforcing ribs 1053. In one implementation, the common intersection point D is also the intersection point of three intersecting reinforcing ribs 1053 of the plurality of reinforcing ribs 1053, so the common intersection point D may be the common intersection point of a total of six ribs (the three intersecting lattice ribs 10511 and the three intersecting reinforcing ribs 1053). Additionally, in one implementation, the reinforcing lattice 1051 of the reinforcement structure 105 formed inside of the two supporting side frames (101, 101') has a thickness of 20 mm, the reinforcing lattice 1051 of the reinforcement structure 105 formed inside of the seat plate 103 has a thickness of 12 mm, and the reinforcing lattice 1051 of the reinforcement structure 105 formed inside of the back plate 104 has a thickness of 5 mm.

Figure 8:
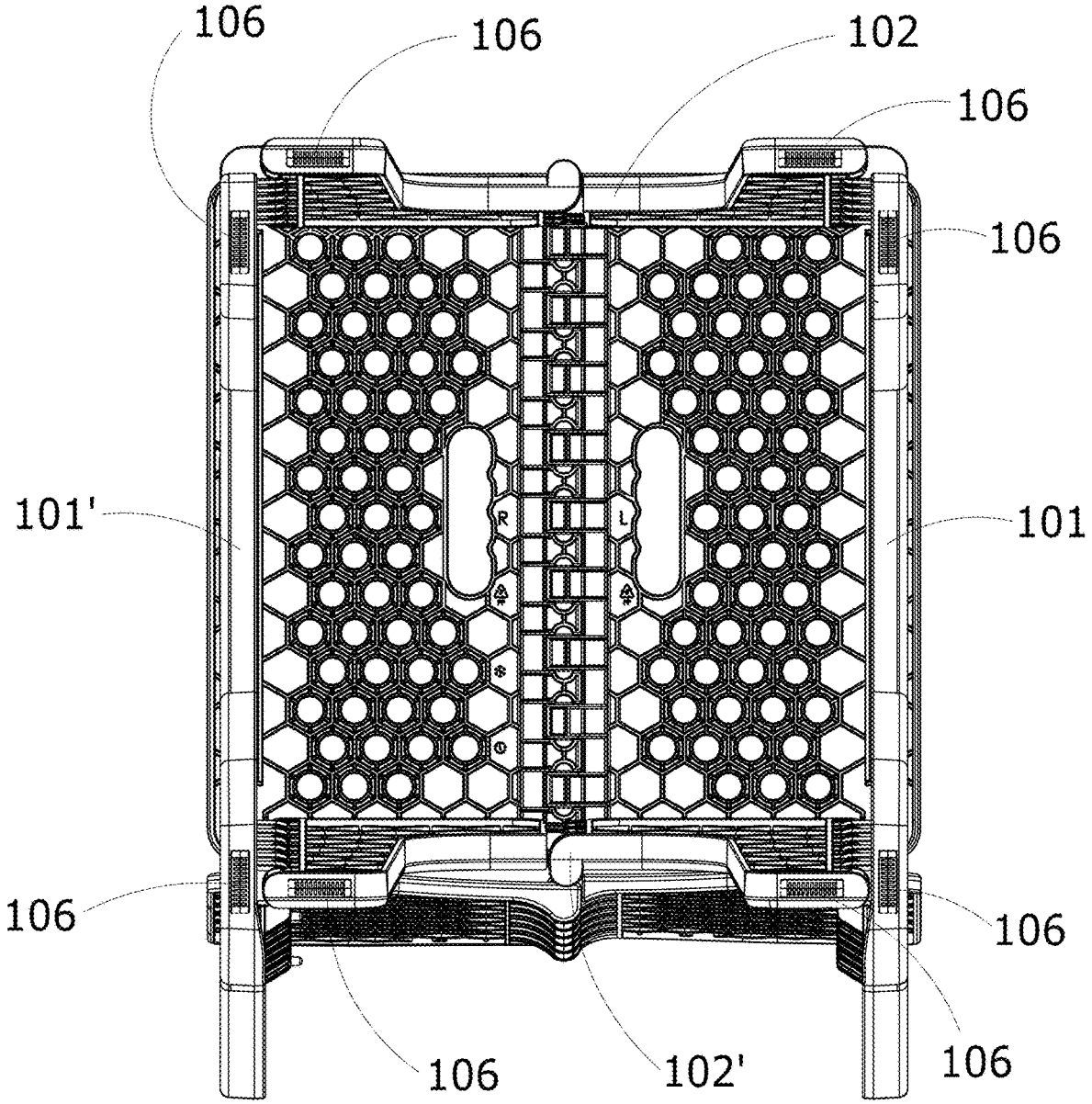
FIG. 8 is a schematic diagram illustrating a foldable chair according to an example implementation of the present disclosure.

Please refer to FIG. 8. The foldable chair 10 of the present disclosure is equipped with at least one anti-slip pad 106 at the bottom portion of each of the two supporting side frames (101, 101') and each of the two connecting plates (102, 102'). The anti-slip pad 106 provides a non-slip function, which prevents the foldable chair 10 from being displaced by an externa force while in use, so as to ensure the overall stability of the foldable chair 10.

The following are the verification results of the back plate and seat plate after reinforcement:

Experiments were conducted on an embodiment 1 and a comparative embodiment 1, where the embodiment 1 and the comparative embodiment 1 have different actual dimensions. Specifically, embodiment 1 has an unfolded dimensions of 430×325×755 (mm), while comparative embodiment 1 has an unfolded dimension of 500×420×997 (mm).

Figure 9B:
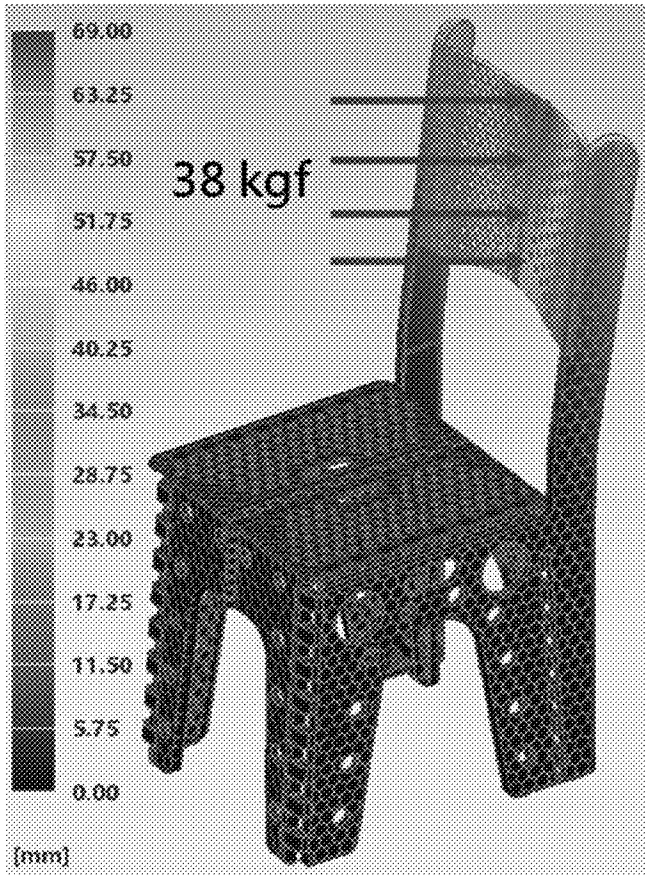
FIG. 9A and FIG. 9 B are deformation distribution diagrams illustrating back plates of an embodiment 1 and a comparative embodiment 1 after applying the same force according to an example implementation of the present disclosure.
Figure 9A:
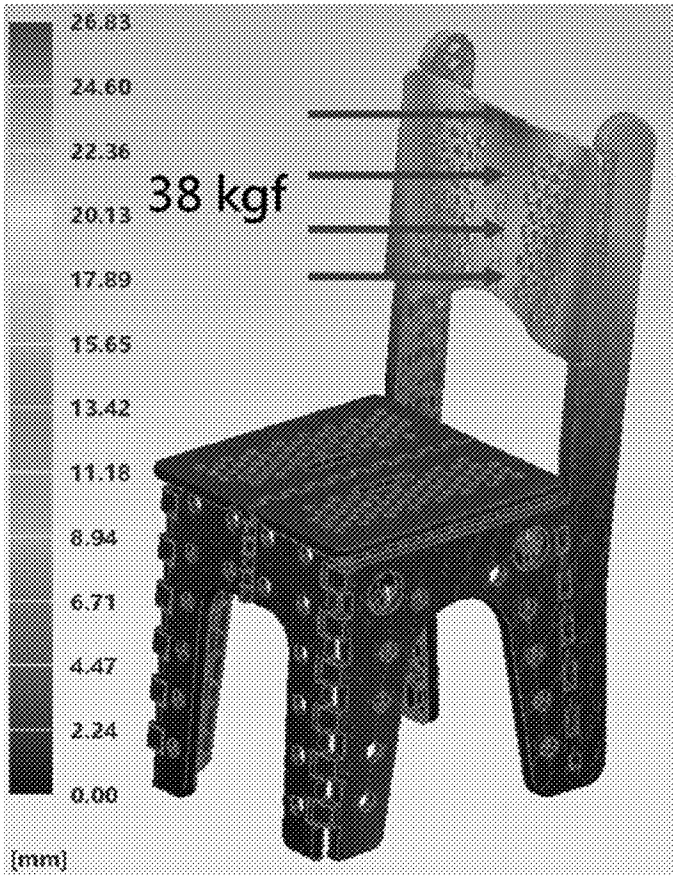

The back plates of embodiment 1 and comparative embodiment 1 of the present disclosure were tested for compression resistance. A weight of 38 Kgf was applied to each of the back plate of embodiment 1 (the back plate 104 of the present disclosure is hereinafter referred to as the back plate 200) and the back plate of comparative embodiment 1 (referred to as back plate 300). The analysis was conducted using computer aided engineering (CAE) simulation calculation methods, and the results are shown in FIG. 9 A and FIG. 9 B.

The main difference between the back plate 300 of comparative embodiment 1 and the back plate 200 of embodiment 1 is that the back plate 300 does not include the reinforcing ring, a plurality of reinforcing ribs, and top supporting parts of the two supporting side frames included in the reinforcement structure of the present disclosure.

TABLE 1

The maximum deformation value of embodiment 1 and comparative embodiment 1.

| | Embodiment 1 | Comparative embodiment 1 |
|---|---|---|
| Maximum deformation value (mm) | 26.83 | 69 |

In Table 1, it may be observed that the maximum deformation value of the back plate 300 in comparative embodiment 1 is 2.6 times higher than the maximum deformation value of the back plate 200 in embodiment 1, which indicates that in embodiment 1, compared to comparative embodiment 1, the maximum deformation value of the back plate 200 is reduced, thereby effectively improve the compression resistance of the back plate 200.

Figure 10B:
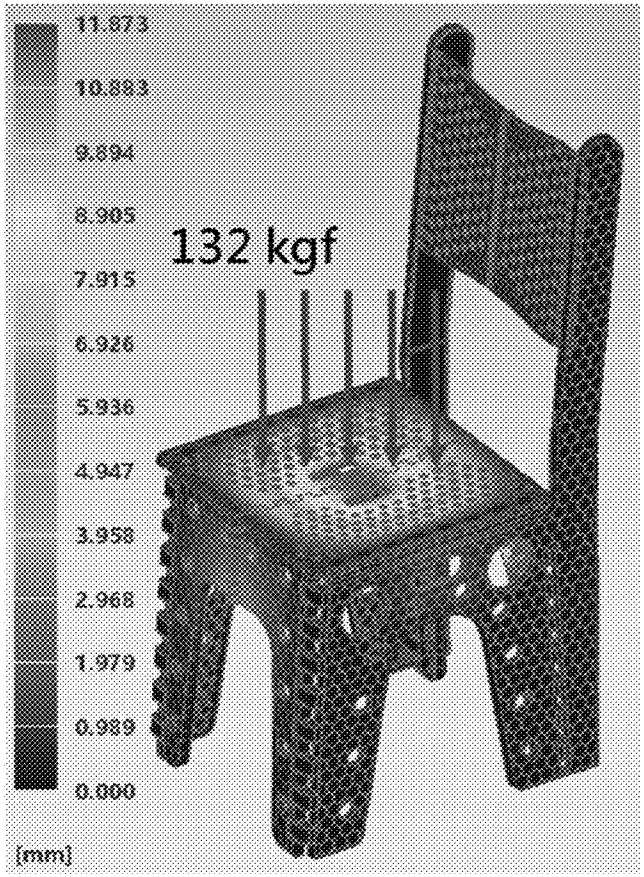
FIG. 10A and FIG. 10 B are deformation distribution diagrams illustrating seat plates of an embodiment 1 and a comparative embodiment 1 after applying the same force according to an example implementation of the present disclosure.
Figure 10A:
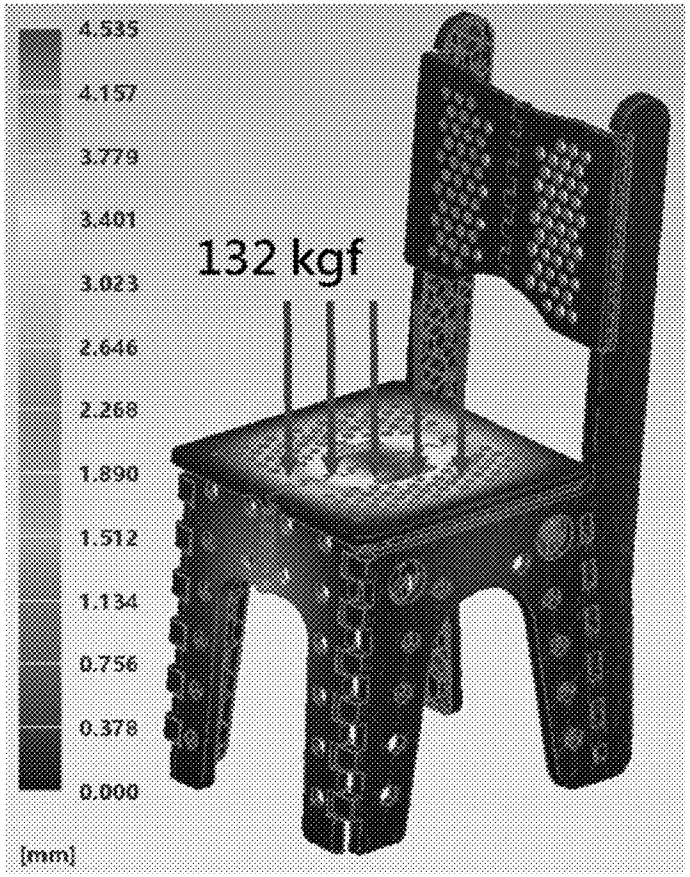

The seat plates of embodiment 1 and comparative embodiment 1 of the present disclosure were tested for compression resistance. A weight of 132 Kgf was applied to each of the seat plate of embodiment 1 (the back plate 104 of the present disclosure is hereinafter referred to as the back plate 400) and the seat plate of comparative embodiment 1 (referred to as seat plate 500). The analysis was performed using CAE simulation calculation methods, and the results are shown in FIG. 10A and FIG. 10 B.

The main difference between the seat plate 500 of comparative embodiment 1 and the seat plate 400 of embodiment 1 is that the seat plate 500 does not include the reinforcing rings and a plurality of the reinforcing ribs of the reinforcement structure of the present disclosure.

Table 2 shows the maximum deformation values of embodiment 1 and comparative embodiment 1.

| | Embodiment 1 | Comparative embodiment 1 |
|---|---|---|
| Maximum deformation value (mm) | 4.54 | 11.87 |

According to Table 2, it may be observed that the maximum deformation value of the seat plate 500 in comparative embodiment 1 is 2.61 times higher than the maximum deformation value of the seat plate 400 in embodiment 1, which indicates that in the embodiment 1, compared to the comparative embodiment 1, the maximum deformation value of the seat plate 400 is reduced, thereby effectively improve the compression resistance of the seat plate 400.

The embodiments shown and described above are only examples. Many details are often found in the art. Therefore, many such details are neither shown nor described. Even though numerous characteristics and advantages of the present disclosure have been set forth in the foregoing description, together with details of the structure and function of the present disclosure, the present disclosure is illustrative only, and changes may be made in the details. It will therefore be appreciated that the embodiment described above may be modified within the scope of the claims.

What is claimed is:

1. A foldable chair comprising:

two supporting side frames, each formed with a first supporting part and a second supporting part;

two connecting plates, each formed with a first folding line, the two connecting plates arranged between the two supporting side frames and pivotally connected to each of the two supporting side frames, each of the two connecting plates is foldable in a flat manner through the first folding line;

a seat plate formed with a second folding line, the seat plate is arranged between two first supporting parts of the two supporting side frames, two sides of the seat plate are respectively and pivotally connected to the two first supporting parts of the two supporting side frames, such that the seat plate is foldable in a flat manner through the second folding line; and a back plate formed with a third folding line, the back plate arranged between two second supporting parts of the two supporting side frames, two sides of the back plate are respectively and pivotally connected to the two second supporting parts of the two supporting side frames, such that the back plate is foldable in a flat manner through the third folding line, wherein:

an inner side of at least one of the two supporting side frames, the two connecting plates, the seat plate, or the back plate is formed with a reinforcement structure, the reinforcement structure further comprises:

a plurality of reinforcing lattices arranged in a honeycomb shape;

a plurality of reinforcing rings, each of the plurality of reinforcing rings formed in one of the plurality of reinforcing lattices; and a plurality of reinforcing ribs, each of the plurality of reinforcing ribs connected between an inner wall of one of the plurality of reinforcing lattices and an outer wall of one of the plurality of reinforcing rings, and each of the two connecting plates is foldable in the flat manner along the first folding line, the seat plate is foldable in the flat manner along the second folding line, and the back plate is foldable in the flat manner along the third folding line, such that a distance between the two supporting side frames is reduced.

2. The foldable chair according to claim 1, wherein a top portion of one of the two connecting plates is formed with a limiting column, and the seat plate comprises a limiting hole corresponding to the limiting column, when the seat plate and the two connecting plates are unfolded, the limiting column is inserted into the limiting hole.

3. The foldable chair according to claim 1, wherein each of the two connecting plates comprises a first plate and a second plate, and the reinforcement structure is formed on an inner side of each of the first plate and the second plate.

4. The foldable chair according to claim 1, wherein the seat plate comprises a first bearing plate and a second bearing plate, and the reinforcement structure is formed on an inner side of each of the first bearing plate and the second bearing plate.

5. The foldable chair according to claim 1, wherein the back plate comprises a first supporting plate and a second supporting plate, and the reinforcement structure is formed on an inner side of each of the first supporting plate and the second supporting plate.

6. The foldable chair according to claim 1, wherein the two second supporting parts of the two supporting side frames are each formed with at least one top supporting part extending from a pivot part relative to the back plate, when two sides of the back plate are respectively and pivotally connected to the two second supporting parts of the two supporting side frames, the at least one top supporting part is configured to provide support to the back plate to pivotally connect to one side of one of the second supporting parts.

7. The foldable chair according to claim 1, wherein the plurality of reinforcing rings is formed with a through hole.

8. A foldable chair according to claim 1, wherein each of the plurality of reinforcing lattices comprises six lattice ribs and is arranged in the honeycomb shape in a hexagonal pattern, each of the lattice ribs simultaneously serves as a common lattice rib for two of the plurality of reinforcing lattices;

the plurality of reinforcing rings are all arranged in the plurality of reinforcing lattices in a circular shape;

three adjacent reinforcing lattices in the plurality of reinforcing lattices comprise a common intersection point, and the common intersection point is formed by three intersecting lattice ribs in the plurality of lattice ribs; and one of the plurality of reinforcing ribs extends along a direction of one of the three intersecting lattice ribs, such that the common intersection point and one of the plurality of reinforcing rings are connected.

9. The foldable chair according to claim 1, wherein at a bottom portion of each of the two supporting side frames and at a bottom portion of each of the two connecting plates comprise at least one anti-slip pad.

* * * * *